US006823930B2

(12) United States Patent
Wuethrich

(10) Patent No.: US 6,823,930 B2
(45) Date of Patent: Nov. 30, 2004

(54) VENTING VALVE ASSEMBLY FOR CASTING MOULDS

(75) Inventor: Andreas Wuethrich, Onex (CH)

(73) Assignee: Fondarex SA, St. Leigier (CH)

( * ) Notice: Subject to any disclaimer, the term of this patent is extended or adjusted under 35 U.S.C. 154(b) by 35 days.

(21) Appl. No.: 10/245,981

(22) Filed: Sep. 18, 2002

(65) Prior Publication Data

US 2003/0056931 A1 Mar. 27, 2003

(30) Foreign Application Priority Data

Sep. 21, 2001 (CH) ..... 1750/01

(51) Int. Cl.[7] ..... B22D 17/00

(52) U.S. Cl. ..... 164/305; 164/410; 164/155.1; 164/155.3; 164/155.4

(58) Field of Search ..... 164/305, 410, 164/155.1, 155.3, 155.4

(56) References Cited

U.S. PATENT DOCUMENTS 5,113,984 A * 5/1992 Benford ..... 192/3.3
6,158,495 A * 12/2000 Bigger ..... 164/155.1
6,513,568 B1 * 2/2003 Wyser ..... 164/305

FOREIGN PATENT DOCUMENTS

EP 0 612 573 A2 8/1994
EP 1 018 384 A1 7/2000

* cited by examiner

*Primary Examiner*—Kiley S. Stoner
*Assistant Examiner*—I.-H. Lin
(74) *Attorney, Agent, or Firm*—Maginot, Moore & Beck

(57) ABSTRACT

The venting valve assembly for casting moulds comprises a venting valve for closing a venting channel. The venting valve comprises a valve housing in which a closure member is received that is movable between an open position and a closed position. The closure member can be frictionally locked in its open position and simultaneously biased in closing direction. For frictionally locking the closure member, a chamber is provided that can be put under a hydraulic overpressure. The chamber has a wall portion that bulges towards the closure member in response to the overpressure. The wall portion is resilient such that it moves back to a position releasing the closure member once the overpressure in the chamber is reduced. For reducing the pressure in the chamber, a release valve is provided which is controlled by a sensor detecting any casting material penetrating into the venting channel. The biasing of the closure member in closing direction is performed pneumatically.

18 Claims, 3 Drawing Sheets

VENTING VALVE ASSEMBLY FOR CASTING MOULDS

BACKGROUND OF THE INVENTION

The present invention refers to a venting valve assembly for casting moulds, comprising a venting valve having a valve housing, a venting channel located in the interior of the valve housing, and a valve closure member located in the interior of the valve housing and adapted to move between an open position and a closed position.

In order to reliably avoid the occurrence of air inclusions in the finished casting during the casting operation, the mould and the cavity in the mould, respectively, have to be vented during the casting operation. Thereby, not only the air contained in the cavity of the mould has to be allowed to escape, but in addition it must be ensured that also the gases escaping from the liquid casting material are removed from the mould cavity.

One of the problems in connection with venting die casting moulds can be seen in the requirement that the venting valve of the valve assembly be closed as late as possible in order to ensure that the mould cavity is vented until it is fully filled with liquid casting material, but that it is also to be avoided that liquid casting material enters the venting valve.

In order to take this problem into account, generally two kinds of valve assemblies for die casting moulds are known, whereby in either case a venting valve is provided that is equipped with a axially back and forth movable valve piston for closing the venting channel. While the valve piston is moved by suitable driving means in a first kind of valve assemblies, the valve piston of a second kind of valve assemblies is operatively connected to a power pick-up member that is operated directly by the liquid casting material flowing from the cavity of the mould into the venting channel, thereby making use of its inherent kinetic energy.

Suitable driving means for the above mentioned first kind of valve assemblies may include pneumatically or hydraulically operated driving systems for moving the valve piston. The moment in which the closing of the venting valve is initiated can be determined, for example, by means of a sensor that monitors the level of the mould cavity. However, one difficulty observed with such systems consists in the fact that the closing operation takes a considerably long time because the signal initiating the closing operation, mostly an electric signal, has to be transformed into a mechanical movement, for example into the operation of a servo valve. Moreover, for the purpose of closing the venting valve or for the purpose of operating an actuating member that is operatively connected to the valve piston of the venting valve, a predetermined system pressure must be available in order to ensure that the venting valve can be pneumatically or hydraulically closed within the required time period. However, since the operation of a servo valve usually causes a drop in system pressure, it is necessary to rebuild the system pressure again before the servo valve can be closed. Finally, in most cases, a locking mechanism holding the valve piston in its open position has to be operated, resulting in an additional delay of the closing operation. It is understood that such valve assemblies are of a quite complicated design and require a high expenditure; moreover, they are subject to be influenced by certain operation parameters. Moreover, such valve assemblies usually require at least appr. 10 milliseconds from the detection of the intruding casting material to reach the fully closed position of the valve assembly.

In contrary, with the second kind of valve assemblies, it is possible to realize very quick acting and reliable venting devices. In order to ensure that a ram pressure can be built up that is high enough to operate the venting valve piston, the venting channel leading from the mould cavity to the power pick-up member is provided with a number of deviations and constrictions. Moreover, the venting channel must have a certain minimal distance and has to be of angled design between the power pick-up member and the real valve body member of the venting valve, in order to ensure that the venting valve is safely closed before the liquid casting material has reached the venting valve. In order to increase the efficiency of such valve assemblies, usually a vacuum pump is connected to the venting valve.

PRIOR ART

The document EP 0 612 573 discloses a valve assembly referred to herein for venting diecasting moulds, comprising a venting channel, a venting valve located in the venting channel and an operating means for closing the venting valve. The operating means comprises an impact transmitter that is exposed to the liquid casting material advancing from the mould cavity into the venting channel. The impact transmitter is mechanically operationally coupled to the movable closure element of the venting valve. Thereby, the impact transmitter is designed as a push member having an operating stroke that is limited to a fraction of the stroke to be passed through by the movable element of the venting valve. Moreover, the closure element of the venting valve is freely movable along the path exceeding the operating stroke of the impact transmitter, and the operating means comprises a power transmission member for transmitting the impact impulse from the impact transmitter to the movable closure member of the venting valve.

Even if such a venting valve assembly operates very reliably in practice, it remains desirable in certain applications that the energy required for closing the venting valve would not be supplied from the moving casting material alone. As is clearly evident from the fundamental formula for calculating the kinetic energy ($E=m\cdot v^2/2$), the energy available for closing the venting valve depends on the mass and on the velocity of the casting material. In other words, that means that the available energy might not be sufficient under certain unfavorable operating conditions, particularly in the case of low casting material mass and/or low flow velocity of the fluid casting material to close the venting valve within the required time period. On the other side, in the case of high casting masses and/or high flowing velocities thereof, a high energy impact can act on the impact transmitter, with the result that the transmitter and the closure member hit the end stop and/or the valve seat with a high speed; in view of good reliability and long service life of the venting valve assembly, this is highly undesirable.

OBJECTS OF THE INVENTION

Therefore, it is an object of the present invention to provide a venting valve assembly for casting moulds which can be universally used due to the fact that its closure element is moved very quickly from the open position to the closed position, independent from the casting operation parameters, i.e. independent of the design of the casting apparatus and/or the nature of the casting material.

SUMMARY OF THE INVENTION

To meet this and other objects, the present invention provides a venting valve assembly for casting moulds, comprising a venting valve having a valve housing and a venting chamber located in the valve housing, a venting channel located in the interior of the valve housing and communicating with the venting chamber, and a valve closure member located in the interior of the valve housing and adapted to move between an open position in which the venting channel connects the venting chamber with the ambient atmosphere, and a closed position in which the venting channel seals the venting chamber against the ambient atmosphere.

Moreover, the venting valve assembly comprises first means for frictionally locking the valve closure member in the open position and second means for biasing the valve closure member towards the closed position when the valve closure member is in its frictionally locked open position.

With such a venting valve assembly, the valve closure member can be brought into its closed position extremely quickly, because the time required for releasing the frictional lock is very short and because the valve closure member is already biased to quickly move in its closed position.

In a preferred embodiment of the venting valve assembly, a venting valve is provided having a chamber that can be hydraulically or pneumatically pressurized and that incorporates a wall portion bulging towards the closure member in response to the overpressure in the chamber to thereby frictionally lock the closure member in its open position. Thereby, the wall portion is elastically deformable to such a degree within the limits of elasticity of the material it is made of that it returns to its former undeformed shape once the hydraulic or pneumatic overpressure in the chamber is reduced, thereby releasing the valve closure member. Compared to venting valves disclosed in the prior art, it is not required to build-up a pressure and/or to bring a closure member from a locked into an unlocked state first in order to enable the closure member to move from its open to its closed position; rather, only the pressure in the chamber has to be reduced to such a degree that the wall portion of the chamber moves elastically back to release the closure member which, in turn, suddenly moves from its open to its closed position. Such pressure reduction can be performed, for instance, by actuating a release valve. The entire closing time of the valve assembly, counted from the detection of the casting material in the venting channel up to the completion of the closing of the valve, can be substantially reduced, as compared to previously known venting valve assemblies.

BRIEF DESCRIPTION OF THE DRAWINGS

In the following, an embodiment of the venting valve assembly according to the invention will be further described, with reference to the accompanying drawings, in which.

DETAILED DESCRIPTION OF A PREFERRED EMBODIMENT

Figure 1:
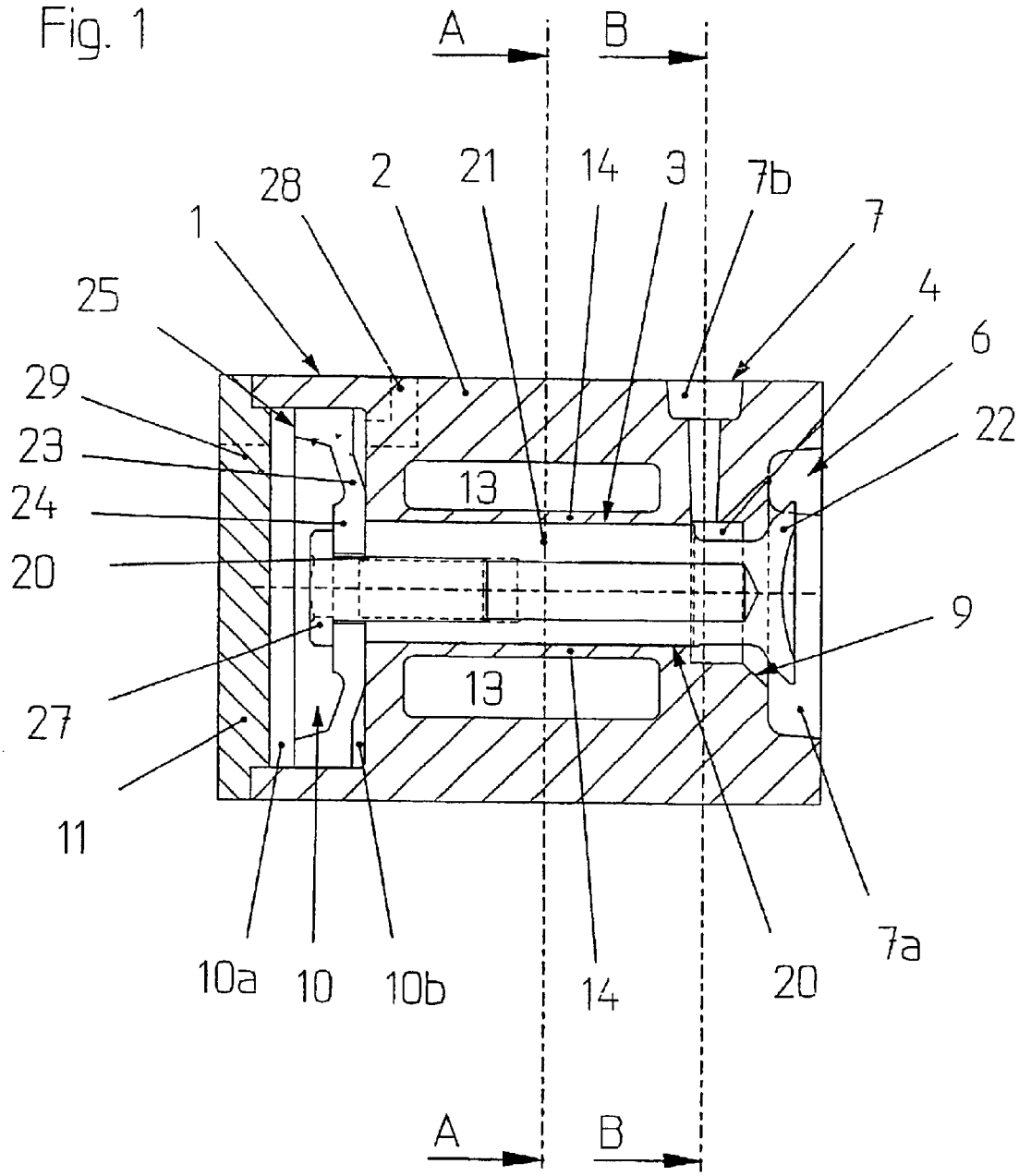
FIG. 1 shows a longitudinal sectional view of a venting valve.

FIG. 1 shows a longitudinal sectional view of a venting valve 1, and the general design thereof shall be further explained with the aid of this illustration. As can be seen in the drawing, the venting valve 1 comprises a round valve housing 2 having a central valve channel 3 adapted to receive and guide a closure member 20. The front end of the valve housing 2, i.e. the right side thereof as seen in FIG. 1, is provided with a venting chamber 6 communicating with a venting channel 7. Moreover, the venting chamber 6 also communicates with the valve channel via a valve seat 9.

The venting chamber 6 is located between a first portion 7*a* of the valve channel 7, communicating with the cavity of the casting mould (not shown) to be vented, and a second portion 7*b* of the venting channel 7 opening at the upper side of the valve housing 2. The above mentioned second portion 7*b* of the venting channel 7 radially opens into a valve chamber 4 located upstream of the valve channel 3 and adjacent to the valve seat 9. The back side of the valve housing 2 is provided with a pneumatic chamber 10 that is closed by means of a cover 11. Moreover, the valve housing comprises a hydraulic chamber 13 surrounding the valve channel 3.

Figure 2:
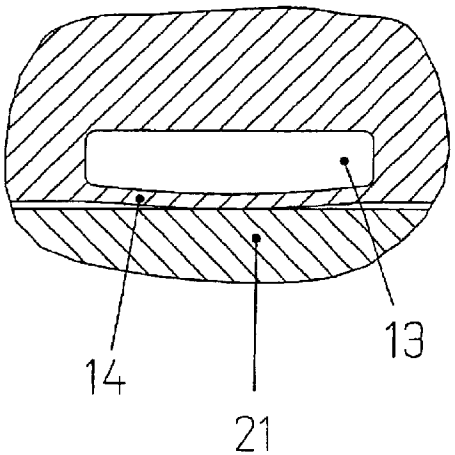
FIG. 2 shows a view of a detail of the venting valve of FIG. 1.
Figure 5:
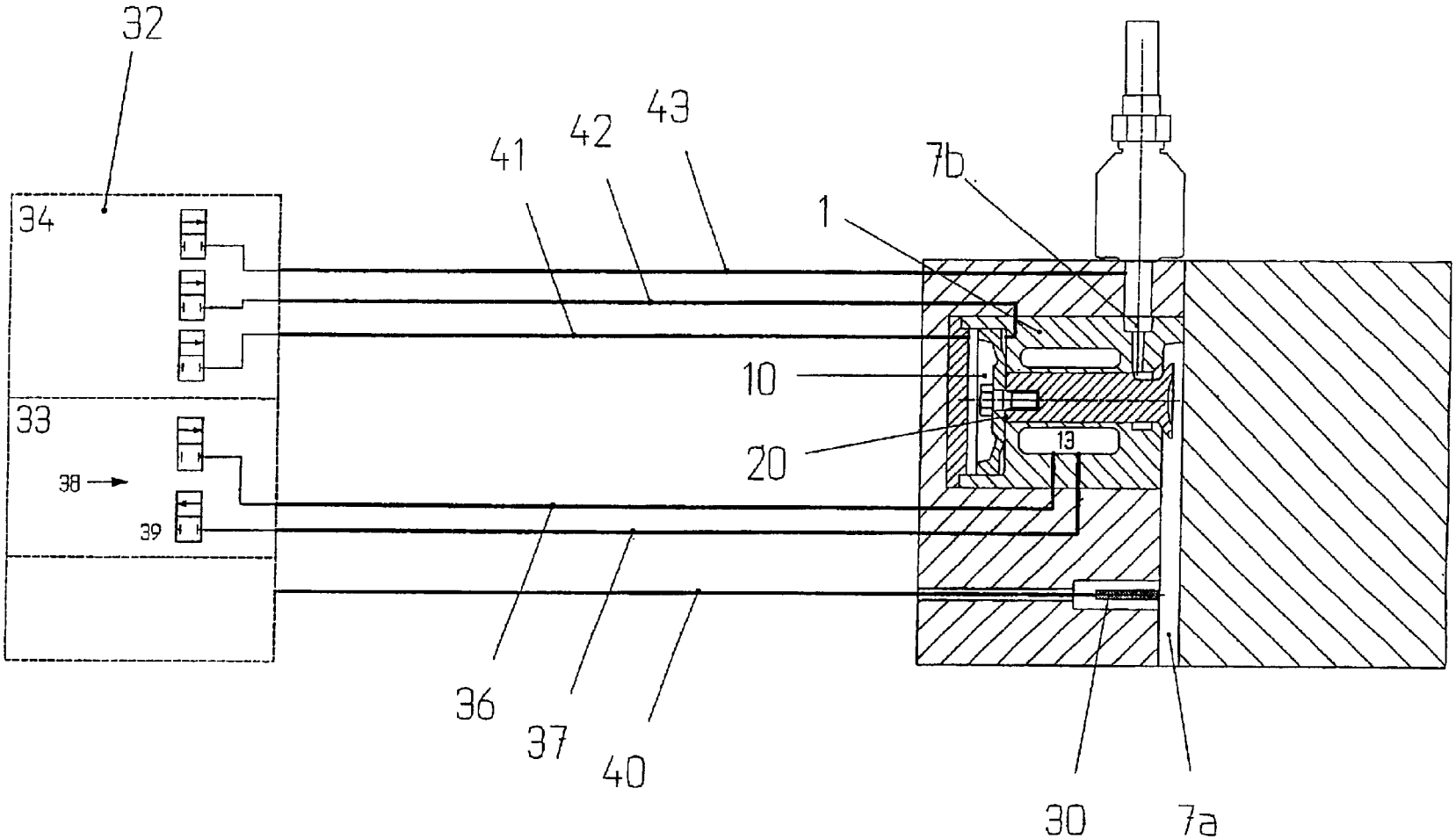
FIG. 5 shows a schematic illustration of the entire venting valve assembly.

The hydraulic chamber 13 is provided with a relatively thin wall portion 14 which faces the valve channel 3. Under the influence of an overpressure that can be created in the interior of the hydraulic chamber 13, the thin wall portion 14 is elastically deformed towards the valve channel 3, as can be seen in FIG. 2. However, it is understood that the enlarged illustration of FIG. 2 is heavily exaggerated for the sake of clarity. Moreover, it is to be noted that it can make sense, in certain fields of application of the venting valve 1, to use a gaseous medium instead of a fluid medium for creating an overpressure in the hydraulic chamber 13. In this context, the expression "hydraulic chamber" shall not have a limiting meaning.

In the interior of the valve channel 3, the valve closure member 20 is located, movable between an open position and a closed position, and shown in FIG. 1 in its open position. The closure member 20 comprises a valve shaft 21 having at its end a valve head 22 acting as a cone valve. By means of that valve head, the venting channel 7 can be closed at the valve seat 9, if required, with the result that no casting material can penetrate from the first portion 7*a* of the venting channel 7 into the valve channel 3 and into the second portion 7*b* of the venting channel 7. The other end of the valve shaft member 21, opposite to the valve head member 22, is provided with a valve disc member 23, connected to the shaft member 21 by means of a screw 27. The valve disc member 23 is provided with a circumferential collar 25, serving as a stop member, as well as an elastically deformable intermediate portion 24. The valve disc 23 is located in the interior of the pneumatic chamber 10, whereby the valve disc 23, and therewith the closure member 20, can be moved, under the influence of a pneumatic medium, both to the right into the open position shown in FIG. 1 and to the left into the closed position. For this purpose, two channels 28, 29 are provided which open into the pneumatic chamber in front of and behind the valve disc 23, respectively.

Figure 3:
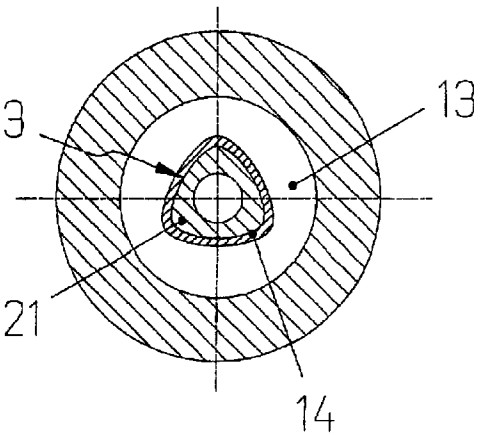
FIG. 3 shows a cross sectional view of the venting valve of FIG. 1, taken along the line A—A in FIG. 1.

FIG. 3 shows a cross sectional view of the venting valve 1, taken along the line A—A in FIG. 1. As can be seen from this drawing, both the valve channel 3 and the valve shaft member 21 have an essentially polygonal cross sectional shape. Amongst else, this has the advantage that the valve disc 23 can be easily removed from the valve shaft member 21 by removing the screw 27 fixing the valve disc 23 to the valve shaft member 21, without the need of retaining the valve shaft member 21, since the valve shaft member 23 cannot rotate in the valve channel 3 due to its essentially polygonal cross sectional shape. Moreover, an essentially polygonal cross sectional shape of the valve channel 3 favors a clamping, frictional blocking of the closure member 20.

Figure 4:
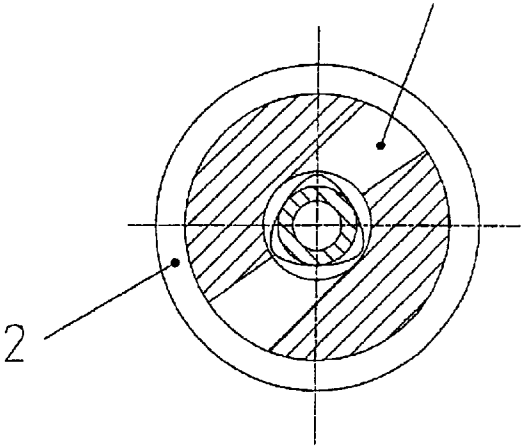
FIG. 4 shows a cross sectional view of the venting valve of FIG. 1, taken along the line B—B in FIG. 1.

FIG. 4, showing a cross sectional view of the venting valve 1 taken along the line B—B in FIG. 1, illustrates the location of the portion 7*b* of the venting channel 7; particularly, it can be seen that the portion 7*b* of the venting channel 7 leads out of the housing 2 on two opposite sides thereof.

In the following, the fundamental design and the operation of the venting valve assembly will be further explained, whereby reference is made to FIG. 3, showing a schematic illustration of the assembly, and to FIG. 1.

Besides the real venting valve 1, the venting valve assembly comprises a sensor 30 preferably located in the interior of the first portion 7*a* of the venting channel 7. By means of the sensor 30, the intrusion of fluid casting material into the venting channel 7 can be detected. Moreover, a control unit 32 is provided, comprising a hydraulic pressure source 33 as well as a pneumatic pressure source 34. The hydraulic pressure source 33 is connected to the hydraulic chamber 13 by means of an advance conduit 36 and a return conduit 37. Furthermore, a release valve assembly 38 is provided, comprising amongst else a release valve 39 inserted into the return conduit 37 by means of which a quick removal of an overpressure present in the hydraulic chamber 13 can be realized. The operation of the release valve 39, i.e. the opening thereof, is initiated by a signal from the sensor 30, symbolized in the drawing by a connection 40 running from the sensor 30 to the release valve 39.

In order to enable the valve disc 23 to be actuated pneumatically, two conduits 41, 42 are provided, running from the pneumatic pressure source 34 to the pneumatic chamber 10. The underpressure in the venting channel 7 can be measured by means of a third conduit 43. As a pneumatic pressure source, usually a shopsite provided pressure source is used; however, it is possible to provide a separate pressure source as well. Moreover, connected to the second portion 7*b* of the venting channel 7, an underpressure source is provided for forcedly venting the cavity of the casting mould.

In order to vent a cavity of a casting mould (not shown) via the venting valve 1, the latter one has to be put into its open position, as shown in FIG. 1. For this purpose, an overpressure is created via the conduit 41 and the channel 29 in the left portion 10*a* of the pneumatic chamber 10, resulting in a movement of the valve disc 23, together with the closure member 20, to the right as seen in FIG. 1 into the open position shown in FIG. 1. Thereafter, an overpressure amounting to about 100 bar is developed in the hydraulic chamber 13 via the conduit 36, resulting in a bulging of the wall portion 14 of the chamber 13 towards the valve shaft 21, whereby the closure member 20 is clampingly fixed in its open position. Now the other side of the valve disc, i.e. the right side as seen in FIG. 1, is subjected to an overpressure developed via the conduit 42 and the channel 28, resulting in a pneumatic biasing of the valve disc 23 and, therewith, the closure member 20 in the direction towards its closed position. It is understood that all elements of the venting valve 1 are adjusted to each other such that the closure member 20 is reliably held by friction in its open position under the influence of the deformed wall portion 14, even if the valve disc 23 is fully pneumatically biased towards the closing direction of the closure member 20.

The venting valve 1 thereby is in its venting position, in which air and gases, respectively, are sucked continuously off the cavity of the casting mold through the venting channel 7 before and during the real casting operation. As soon as the casting material has reached the sensor 30, the latter one generates an electric signal which is used, directly or indirectly, for opening the release valve 38. By opening the release valve 38, the overpressure in the hydraulic chamber 13 is suddenly removed, because only a very small amount of hydraulic fluid has to be released off the hydraulic chamber 13 in order to enable the elastically deformed wall portion 14 to resiliently move back in its original position. Once the wall portion 14 has moved back, the frictional clamping action on the closure member 20 is released and the pneumatically biased closure member 20 is rapidly moved from its open position to its closed position.

Assisting this movement is the valve disc 23 by absorbing the kinetic energy of the closure member 20 in the sense of a resilient stop member. In other words, first, the collar 25 of the valve disc 23 abuts against the cover 11, and then, the kinetic energy is absorbed by the resiliently deforming intermediate portion 24 of the valve disc 23. For this purpose, the valve disc 23 is manufactured of an elastic material having high self dampening, whereby the elastic intermediate portion 24 is designed such that it is deformed only within the limit of elasticity of the material. As a material for manufacturing the valve disc 23, particularly compound fiber materials are useful because they are light-weight and because their characteristics can be easily influenced, for example as far as their inner self dampening behavior is concerned.

The assembly valve disc/closure member is designed and dimensioned such that the valve head does 22 not yet sealingly contact the valve seat 9 when the collar 25 of the valve disc 23 has come to a rest on the cover 11 of the pneumatic chamber 10. Thus, the kinetic energy transmitted during the closing movement to the closure member 20 is absorbed in a controlled manner. Once the collar 25 of the valve disc 23 has come to a rest on the cover 11 of the pneumatic chamber 10, the valve disc is further elastically deformed under the influence of the kinetic energy still inherent to the closure member 20 to such a degree that the valve head 22 sealingly rests on the valve seat 9. Such deformed state of the valve disc 23, in which the valve seat 9 is sealingly closed by the valve head 22, is maintained as long as a minimal overpressure, e.g. 5 bar, is present in the pneumatic chamber 10.

Instead of pneumatic means for biasing the closure member 20, it could be possible to use springs for this purpose. Moreover, instead of a hydraulically deformable chamber wall portion 14, for example piezo crystals could be used to clampingly frictionally fix the closure member 20 under the influence of an electric voltage. It is understood that a venting valve assembly could be provided, comprising more than one venting valve 1. Furthermore, instead of a disc valve, a cylindrical valve or a flat valve could be used.

The essential advantages of the venting valve assembly and, particularly, of the venting valve according to the invention may be summarized as follows:

The venting valve is universally usable because the closing thereof is performed independent of the applied process, i.e. independent of the operational parameters of the casting assembly and the casting material.

The closure element is moved from its open position into its closed position reliably and very quickly, i.e. in the region of 1–2 msec. Thus, the venting valve has to be closed only when the casting cavity is completely filled.

The venting valve is of simple design and comprises but a few movable parts. Moreover, no gaskets, springs etc. have to be provided. Therefor, it is very compact, needs nearly no maintenance, it is reliable and it can be manufactured at low costs. Furthermore, it offers a large venting cross section.

The closure element is decelerated in a controlled manner, resulting in an increased service life of the venting valve.

The round design offers many advantages regarding its installation.

What is claimed is:

1. A venting valve assembly for casting moulds; comprising:

a venting valve means having a valve housing means and a venting chamber means located in said valve housing means;

a venting channel means located in the interior of said valve housing means and communicating with said venting chamber means;

a valve closure member located in the interior of said valve housing means and operably relating to said venting channel means, said valve closure member adapted to be movable between an open position in which said venting channel means vents said venting chamber means to the ambient atmosphere, and a closed position in which said venting channel means does not vent said venting chamber means to the ambient atmosphere;

second means for biasing said valve closure member towards said closed position when said valve closure member is in a frictionally locked open position;

a first chamber means located in said valve housing means adjacent to said valve closure member; and a first hydraulic or pneumatic pressure source means connectable to said chamber means for generating a hydraulic or pneumatic overpressure in said first chamber means;

said first chamber means having a wall portion means elastically deformable towards said valve closure member in response to said hydraulic or pneumatic overpressure generated in said first chamber means, thereby frictionally locking said valve closure member.

2. A venting valve assembly according to claim 1 in which said wall portion means is elastically deformable to such a degree within the limits of elasticity of the material it is made of that it returns to its former undeformed shape once said hydraulic or pneumatic overpressure in said first chamber means is reduced, thereby releasing said valve closure member.

3. A venting valve assembly according to claim 2 in which said valve housing means comprises a valve channel means, said valve closure member being movably received in said valve channel means, and said first chamber means at least partially surrounding said valve channel means.

4. A venting valve assembly according to claim 1 in which said second means for biasing said valve closure member comprises;

a second chamber means located in said valve housing means;

a second pneumatic pressure source means connectable to said second chamber means for generating a pneumatic overpressure in said second chamber means; and a valve disc means located in said second chamber means, directly or operationally connected to said valve closure member and adapted to be pneumatically biased in closing direction of said valve closure member by said pneumatic overpressure generated in said second chamber means.

5. A venting valve assembly according to claim 4 in which said valve closure member comprises a valve shaft means and a valve head means connected to one end of said valve shaft means, and said valve disc means is connected to said valve shaft means at its end opposite to said valve head means, said valve disc means being adapted to be pneumatically operated both in opening and closing directions of said valve closure member.

6. A venting valve assembly according to claim 5 in which said valve disc means comprises a collar means serving as a stop means and an elastically deformable intermediate portion means adapted to absorb the kinetic energy of said valve closure member at the end of its closing movement.

7. A venting valve assembly according to claim 6 in which said valve disc means consists of a material having high internal damping characteristics, preferably of a compound fiber material.

8. A venting valve assembly according to claim 5 in which said valve disc means is releasably connected to said valve closure member.

9. A venting valve assembly according to claim 1 in which said second means for biasing said valve closure member comprises a spring means biasing said valve closure member in closing direction.

10. A venting valve assembly according to claim 1 in which said valve housing means comprises a valve channel means, said valve closure member being movably received in said valve channel means, and said first chamber means at least partially surrounding said valve channel means.

11. A venting valve assembly according to claim 10 in which said valve channel means provided in said valve housing means has a non-circular cross sectional shape, and said valve closure member comprises a valve shaft means and a valve head means connected to one end of said valve shaft means, said valve shaft means of said valve closure member having a cross sectional shape corresponding to the cross sectional shape of said valve channel means, while said valve head means has a circular cross sectional shape.

12. A venting valve assembly according to claim 11 in which said valve channel means provided in said valve housing means has a polygonal cross sectional shape.

13. A venting valve assembly according to claim 1, further comprising a pressure release valve means adapted to reduce the overpressure in said first chamber means and, thereby, to release the frictional locking of said valve closure member within a predetermined time period.

14. A venting valve assembly according to claim 13, further comprising a sensor means adapted to detect the presence of casting material in said venting channel means upstream of said valve closure member and operationally connected to said pressure release valve means.

15. A venting valve assembly according to claim 1 in which said valve closure member comprises a valve shaft means and a valve head means connected to one end of said valve shaft means, said valve head means serving as a closure element.

16. A venting valve assembly according to claim 15 in which said valve channel means provided in said valve housing means has a non-circular cross sectional shape, said valve shaft means of said valve closure member having a cross sectional shape corresponding to the cross sectional shape of said valve channel means, while said valve head means has a circular cross sectional shape.

17. A venting valve assembly according to claim 15 in which said venting channel means located in the interior of said valve housing means comprises a first and a second venting channel portion, and said valve housing means comprising a valve seat means located between said first and said second venting channel portions and cooperating with said valve head means.

18. A venting valve assembly according to claim 1 in which said valve closure member comprises a valve shaft means and a valve head means connected to one end of said valve shaft means, said venting channel means located in the interior of said valve housing means comprises a first and a second venting channel portion, and said valve housing means comprising a valve seat means located between said first and said second venting channel portions and cooperating with said valve head means.

* * * * *